United States Patent [19]

Harootian

[11] 3,943,207

[45] Mar. 9, 1976

[54] INJECTION CARBURETOR

[76] Inventor: Simon G. Harootian, 10 Rollingwood Drive, Worcester, Mass. 01609

[22] Filed: Aug. 19, 1974

[21] Appl. No.: 498,709

Related U.S. Application Data

[63] Continuation-in-part of Ser. No. 415,630, Nov. 14, 1973, abandoned, which is a continuation of Ser. No. 198,632, Nov. 15, 1971, abandoned.

[52] U.S. Cl. ..... 261/44 A; 251/205

[51] Int. Cl.[2] ..... F02M 9/08

[58] Field of Search ..... 251/205; 261/44 A

[56] References Cited

UNITED STATES PATENTS

| | | | |
|---|---|---|---|
| 795,357 | 7/1905 | Maxwell | 261/44 A |
| 1,477,280 | 12/1923 | Pordes | 261/44 A |
| 2,386,051 | 10/1945 | Kempton | 251/205 |
| 2,705,135 | 2/1955 | Gehner | 261/41 D |
| 2,899,943 | 8/1959 | Haensel et al. | 261/65 |
| 2,995,349 | 8/1961 | Kennedy, Sr. | 261/44 A |
| 3,105,861 | 10/1963 | Korte | 261/41 D |
| 3,711,068 | 1/1973 | Perry | 261/44 A |

FOREIGN PATENTS OR APPLICATIONS

| | | | |
|---|---|---|---|
| 360,020 | 11/1931 | United Kingdom | 261/44 A |
| 506,276 | 5/1920 | France | 261/44 A |
| 625,006 | 4/1927 | France | 261/44 A |
| 276,581 | 7/1914 | Germany | 261/44 A |

*Primary Examiner*—Tim R. Miles

*Attorney, Agent, or Firm*—Norman S. Blodgett; Gerry A. Blodgett

[57] ABSTRACT

An injection carburetor having a rotatable control element for regulating air and fuel flow and adjustable needles for further controlling fuel flow at high speed and low speed, or an adjustable needle and a fuel tube having a T-shaped slot therein covered and uncovered by axial movement of a tubular control member.

6 Claims, 3 Drawing Figures

II
II

INJECTION CARBURETOR

REFERENCE TO OTHER APPLICATIONS

This application is a continuation-in-part of my application Ser. No. 415,630 filed Nov. 14, 1973, now abandoned, which, in turn, is a continuation of my application Ser. No. 198,632 filed Nov. 15, 1971, now abandoned.

BACKGROUND OF THE INVENTION

It is common practice in snowmobiles to power them by use of two cycle internal combustion engines. In obtaining the most effective use of such engines, particularly in racing, the operator often resorts to strange fuel mixtures. These mixtures, although expensive, can give greater engine performance and, particularly, better acceleration of the snowmobile. The conventional carburetor used on such engines is, however, not capable of handling such fuels effectively. More particularly, the fuel-air ratio is determined by the flow of air past fuel ports and the characteristic curve from low speed to high speed is built into the nature of these ports. This means that, if the engine fuel-air ratio is adjusted at low speed, it will not give good performance at high speed. On the other hand, if it is adjusted to be more sufficient at high speed, it lacks the proper ratio at low speed. Attempts have been made in the past to overcome these deficiencies, but these attempts have resulted in carburetors that are not only very expensive, but also quite delicate and intricate and subject to corrosion from the fuels used in snowmobile racing and the like. These and other difficulties experienced with the prior art devices have been obviated in a novel manner by the present invention.

It is, therefore, an outstanding object of the invention to provide an injection carburetor which is very simple in construction and which is not subject to fouling due to corrosive fuels.

Another object of this invention is the provision of an injection carburetor providing a simple means for obtaining the optimum fuel-air ratio at low speed and at high speed.

A further object of the present invention is the provision of an injection carburetor having a very rugged construction which will not be forced out of adjustment during rugged use, such as during snowmobile racing and the like.

It is another object of the instant invention to provide an injection carburetor particularly for use in 2-cycle engines which is operative even when the engine is moved to substantial angles to the vertical.

With these and other objects in view, as will be apparent to those skilled in the art, the invention resides in the combination of parts set forth in the specification and covered by the claims appended hereto.

SUMMARY OF THE INVENTION

In general, the invention consists of an injection carburetor provided with a housing having a main passage extending therethrough and having a transverse bore extending across the main passage. A cylindrical control body is rotatably carried in the transverse bore and has a flow passage extending through its central portion transversely of its axis. A conjugate means is provided, so that, when the control body is rotated, it also advances axially. A fuel tube extends through the control body from one end into the flow passage and a needle extends into the flow passage from the other end of the control body, the fuel tube, however, being fixedly attached to the housing and not movable with the control body.

More specifically, the fuel tube is provided with a needle at its outer end which is threadedly adjustable for regulating the fuel-air ratio at high speed, while the first-mentioned needle is threadedly mounted in the control body for controlling the fuel-air ratio at low speed.

BRIEF DESCRIPTION OF THE DRAWINGS

The character of the invention, however, may be best understood by reference to one of its structural forms, as illustrated by the accompanying drawings, in which.

DESCRIPTION OF THE PREFERRED EMBODIMENT

Figures 1, 2, 3:
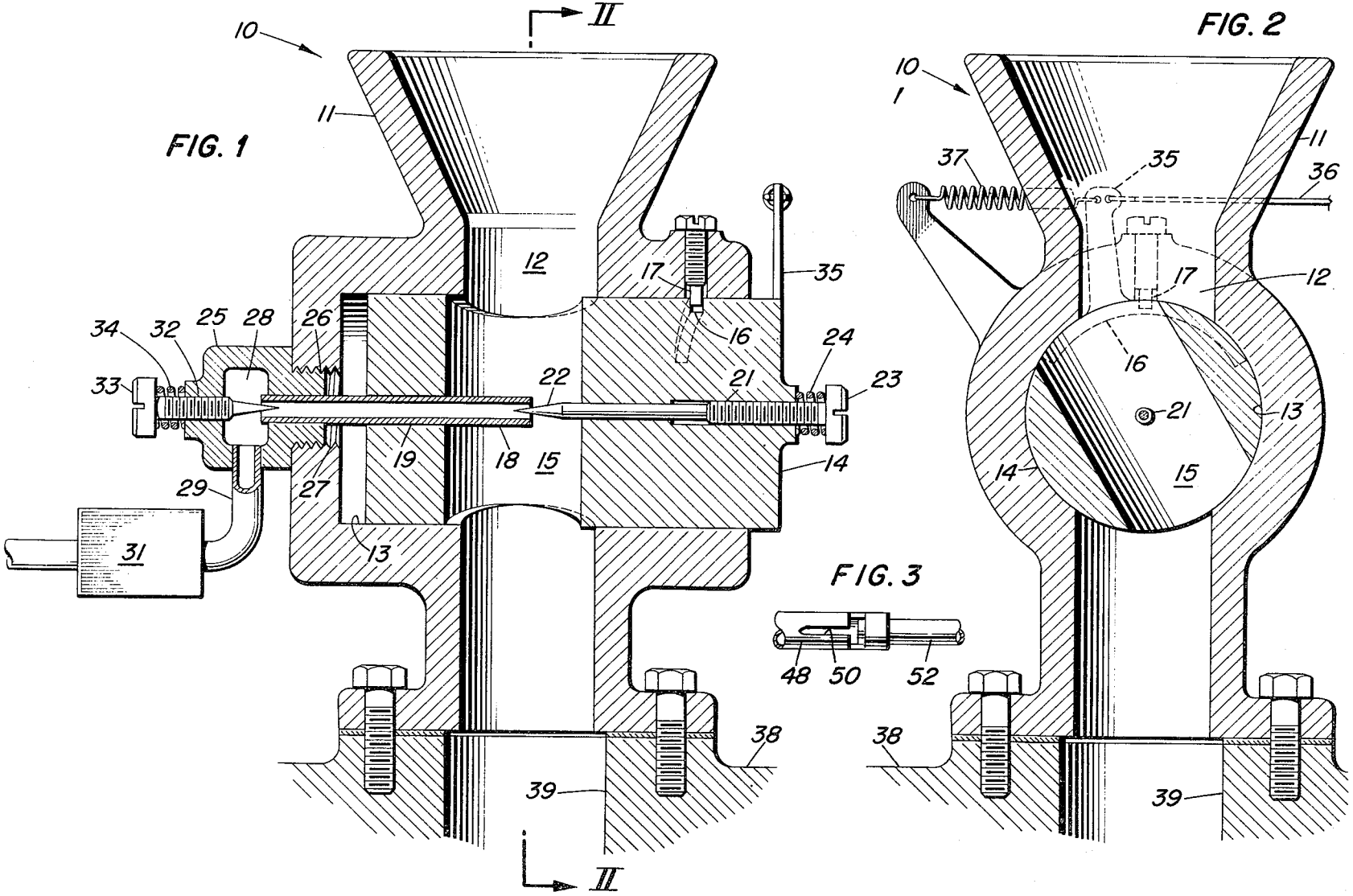
FIG. 1 is a vertical sectional view of an injection carburetor incorporating the principles of the present invention.
FIG. 2 is a vertical sectional view of the carburetor taken on the line II—II of FIG. 1.
FIG. 3 is an elevation view of a modified form of the invention.

Referring to FIGS. 1 and 2, it can be seen that the injection carburetor, indicated generally by the reference numeral 10, is shown as having a housing 11 with a vertical main passage 12 extending entirely through it and a horizontal transverse bore 13 extending in the other direction but opening on one side only. For the purposes of this description, the words "vertical" and "horizontal" will refer to those directions when applied to the carburetor when it is mounted upright on an engine, but it will be understood that the carburetor could be mounted in any number of aspects including the horizontal direction.

A cylindrical control body 14 is rotatably mounted in the transverse bore 13. The control body has a vertical flow passage 15 which extends transversely of its axis and which has substantially the same diameter as the main passage 12 in the housing 11. As a matter of fact, in certain positions of rotation of the control body 14, the flow passage 15 is aligned with the main passage 12.

The housing 11 and the control body 14 are formed of 7075–T6 aircraft aluminum alloy. The contacting surfaces of the housing 11 and the control body 14 are specially treated. These surfaces are principally the transverse bore 13 of the housing and the outer cylindrical surface of the body. They are treated by a process known as the "DURELECTRA process", provided by the Durelectra Corp. of Natick, Mass. The process consists of providing the aluminum surface with a deposit of silicon carbide combined with TEFLON (polytetrafluoroethylene). This gives it a hard scratch-proof characteristic, yet one which allows free sliding action between the surfaces.

The housing 11 and the control body 14 are provided with conjugate means to bring about axial movement of the control body in the bore 13 when it is rotated; this conjugate means consists of a helical groove 16 formed on the outer surface of the control body and a peg 17 extending inwardly of the housing 11 into the bore 13 and into the groove 16. As is evident in the drawings, the peg 17 is in the form of a threaded bolt extending entirely through the housing wall. A suitable fuel tube 18 extends axially through the control body from the left-hand end and has its inner end lying well within the flow passage 15 and is in alignment with the end of the fuel tube 18. The needle 21 is threadedly carried in the control body 14 and is provided at its inner end with a conical surface 22. At its outer end, it is provided with a head 23 which is suitably knurled for finger actuation. Between the head 23 and the body of the control body 14 is compressed a coil spring 24. At the outer end of the fuel tube 18 the housing 11 is provided with an appendage 25 having a suitable threaded neck 26 which is threadedly engaged with a threaded bore 27 extending through the wall of the housing 11 into the closed end of the bore 13 coaxially thereof.

The appendage 25 is provided with an inner chamber 28 into which the outer end of the fuel tube 18 extends. A tube 29 extends through the wall of the appendage into the chamber and is connected at its under end to a source 31 of fuel, which source is, in the preferred embodiment, an electrically-driven pump connected to the fuel tank (not shown). A needle 32 is threadedly engaged in the appendage 25 and extends through its outer wall into the chamber 28. It is provided with a conically-shaped inner end which normally lies in the entrance to the fuel tube 18. The outer end of the needle 32 is provided with an enlarged head 33 which is suitably knurled for finger operation and provided with a transverse slot for screwdriver operation on occasion. A coil spring 34 is compressed between the head 33 and the wall of the appendage 25.

A throttle arm 35 is fixed to the control body 14 and is operated by a control cable 36 and is biased in one direction by a coil spring 37. The carburetor is suitably mounted on a motor 38 having a passage 39 adapted to receive the fuel-air mixture conveyed to the operative portions of the motor.

The operation of the apparatus will now be readily understood in view of the above description. The suction of the engine 38 causes air to enter the carburetor through the passage 12. The amount of air which makes its way entirely through the passage in the housing 11 is controlled by the aspect of the control body 14 within the housing. Naturally, when the angularity is such that the passage 15 is exactly aligned with the passage 12, the maximum air enters the engine. However, when the control body is rotated at some other angle, less air flows through. Fuel enters the system from the source 31; it passes through the tube 29 into the chamber 28 in the appendage 25. It passes from the chamber 28 through the fuel tube 19. It finally arrives at the inner end of the tube generally in the center of the passage 15. The fuel is ejected from the tube because of the fact that it is under pressure. Also, at the same time, the air passing over the end of the tube causes an ejector action which also serves to further draw the fuel into the air flow. The amount of fuel entering the fuel tube 19 at the outer end is determined by the needle 32, while the amount of fuel leaving the inner end of the fuel tube is determined by the needle 21. The amount of fuel which makes its way into the air is determined by several parameters therefor. First, it is determined by the amount of air in the passage 15 passing by the open end of the tube; secondly, it is determined by the pressure placed on the fuel by the source 31; thirdly, it is determined by the amount that the needle 32 blocks the entrance to the tube; and, fourthly, it is determined by the amount that the conical surface 22 on the needle 21 blocks the exit of the tube. As the throttle arm 35 is pulled by the control cable 36 against the bias of the coil spring 37, the control body 14 is rotated in the bore 13. Because of the conjugate means, including the groove 16 and the pin 17, the control body is moved to the right in FIG. 1. It must be assumed that, when the coil spring 37 is the only force acting on the throttle arm, the control body is in "low speed" condition and the least amount of air is allowed to flow through the passage 15. In this low-speed condition, the axis of the passage 15 is the most out-of-alignment with the passage 12, so the least air passes through. As the control body is rotated by the control cable 36 and the throttle arm 35, a passage 15 moves to conditions where it is closed to alignment with the passage 12 until the point is reached where it is exactly aligned and this is the "high speed" condition. Because the tube 18 is fixed to the housing 11 and does not move with the control body 14 and because the needle 21 is fixed to the control body 14 and does move with it, the movement of the body 14 to the right causes the needle surface 22 to move out of the exit from the tube 18 and allow more fuel to enter the flow of air. The point where the needle 21, however, controls the fuel flow from the fuel tube most effectively is at the low-speed of the adjustment. The operation of the engine at low speed is adjusted by moving the needle 21 in and out by rotating it by means of its head 23. On the other hand, the needle 32 is used to adjust the flow of fuel into the tube by rotating it at the high-speed end and this, of course, is accomplished by rotating it by means of its head 33. Springs associated with both needles keep the needle adjustment from changing during operation of the engine due to vibration or the like.

In the modified form of the invention shown in FIG. 3, the only elements changed are the fuel tube 48 and the first control member 52. The member 52 is tubular and slides smoothly in the end of the fuel tube. The fuel tube is provided with a T-shaped aperture 50. The amount of fuel released into the air stream is determined by the amount of the aperture that is blocked by the control member 52.

It can be seen, therefore, that the present invention results in a carburetor which has a number of interesting capabilities. First of all, it is relatively simple and involves very few moving parts. Not only does this mean that the carburetor can be sold inexpensively and, therefore, can come into common usage, there are no intricate parts to become iced up in cold weather, or to require maintenance, as is true in more intricate carburetors. Nevertheless, provision is made for adjusting the fuel flow and the operation of the engine to be effective at both the low speed and the high speed ends of the throttle actuation. It particularly lends itself to snowmobile racing where the operator is apt to experiment with various mixtures of fuel. There are enough adjustable parameters available in the carburetor to allow for adjustment of the optimum efficiency of the engine, no matter what fuel is run through the carburetor.

A mixture of methanol, nitro methane, benzol, and castor oil was used in testing. A 7½ psi electric pump was employed to feed fuel to the injectors rather than the alternate method of crankcase pressure used to pressurize the tank. The engine was fitted with two injectors similar to the present invention, one for each cylinder, and the control takes place by a dual cable linkage made into the existing throttle control on the handlebar. The inside diameter calculated for the flow of fuel through the fuel inlet tube proved correct for proper feed in the high rpm range. It was necessary to increase the taper of the low speed needle to obtain a leaner fuel-air mixture in the intermediate rpm range. The injectors functioned flawlessly and the engine was capable of long periods of idling without "loading up". The response was sharp, due to the proper fuel-air metering. From a standing start when full throttle was applied, the front skis of the snowmobile would lift two feet off the ground and slowly come down until they touched the ground about 150 to 200 feet from the starting point.

It is obvious that minor changes may be made in the form and construction of the invention without departing from the material spirit thereof. It is now, however, desired to confine the invention to the exact form herein shown and described, but it is desired to include all such as properly come within the scope claimed.

The invention having been thus described, what is claimed as new and desired to secure by Letters Patent is:

1. An injection carburetor, comprising a. a housing having a main passage extending therethrough and a transverse bore extending across the main passage, b. a cylindrical control body rotatably mounted in the transverse bore and having a flow passage in the form of a cylindrical bore extending through its central portion transversely of its axis, c. conjugate means extending between the control body and the housing to cause the control body to move axially when it is rotated, the conjugate means consisting of a helical groove formed on the outer surface of the body and a peg fixedly mounted in the housing and having an end lying in the groove, d. a fuel tube mounted in the housing and extending through a suitable axial bore extending into one end of the control body, the inner end of the tube lying in the flow passage centrally thereof, e. a first control member extending axially through the other end of the control body into the flow passage in alignment with the end of the fuel tube, and f. a second control member threadedly mounted in the housing coaxially of the tube and having an end lying in the outer end of the fuel tube to permit high speed adjustment, wherein the first control member is a smaller tube than the fuel tube, so that it telescopes smoothly within it, and wherein the fuel tube has a sidewall which is provided with a T-shaped aperture that is covered and uncovered by axial movement of the first control member.

2. An injection carburetor as recited in claim 1, wherein the leg of the T-shaped aperture is directed toward the outer end of the fuel tube.

3. An injection carburetor as recited in claim 1, wherein a spring-biased throttle arm extends outwardly of an outer end of the control body, wherein both control members are provided at their outer ends with actuating heads, and wherein a coil spring is compressed between each such head and the element into which the control member is threaded.

4. An injection carburetor as recited in claim 3, wherein a passage extends from adjacent the outer end of the fuel tube to a source of fuel under pressure.

5. An injection carburetor as recited in claim 3, wherein the needle is provided at its inner end with a conical surface which at its largest diameter is at least as large as the inner diameter of the fuel tube.

6. An injection carburetor as recited in claim 1, wherein the housing and the control body are formed of aluminum, and wherein the contacting surfaces of the housing and the control body are treated with a deposit of silicon carbide combined with polytetrafluoroethylene.

* * * * *